US009004858B2

(12) United States Patent
Nicolas et al.

(10) Patent No.: US 9,004,858 B2
(45) Date of Patent: Apr. 14, 2015

(54) FAN

(75) Inventors: Frederic Nicolas, Malmesbury (GB); Alan Howard Davis, Malmesbury (GB); James Robert Allan MacDonald, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 679 days.

(21) Appl. No.: 13/327,151

(22) Filed: Dec. 15, 2011

(65) Prior Publication Data

US 2012/0163977 A1 Jun. 28, 2012

(30) Foreign Application Priority Data

Dec. 23, 2010 (GB) ..... 1021911.1

(51) Int. Cl.

| | |
|---|---|
| ***F24F 13/20*** | (2006.01) |
| ***F24F 7/007*** | (2006.01) |
| ***F04D 25/08*** | (2006.01) |
| ***F24F 13/26*** | (2006.01) |
| ***F24F 13/32*** | (2006.01) |
| ***F04F 5/16*** | (2006.01) |

(52) U.S. Cl.

CPC ..... *F24F 7/007* (2013.01); *F04D 25/08* (2013.01); *F04D 25/088* (2013.01); *F24F 13/26* (2013.01); *F24F 13/32* (2013.01); *F04F 5/16* (2013.01)

(58) Field of Classification Search

CPC ..... F04D 25/08; F04D 25/088; F04F 5/46; F04F 5/16; F04F 7/007; F04F 2221/16

USPC ..... 416/246, 244 R, 5, 204 R, 205, 210 R; 415/126, 220

See application file for complete search history.

(56) References Cited

U.S. PATENT DOCUMENTS

| | | | |
|---|---|---|---|
| 2,488,467 | A | 11/1949 | De Lisio |
| 2,583,374 | A | 1/1952 | Hoffman |
| 3,099,965 | A | 8/1963 | Regenscheit |
| 3,270,655 | A | 9/1966 | Guirl et al. |
| 3,795,367 | A | 3/1974 | Mocarski |
| 5,522,704 | A | 6/1996 | Casteel |
| 5,881,685 | A | 3/1999 | Foss et al. |

(Continued)

FOREIGN PATENT DOCUMENTS

| | | |
|---|---|---|
| CN | 101016910 | 8/2007 |
| CN | 101424278 | 5/2009 |

(Continued)

OTHER PUBLICATIONS

Stewart et al., U.S. Office Action mailed Aug. 12, 2014, directed to U.S. Appl. No. 13/547,749; 10 pages.

(Continued)

*Primary Examiner* — Nathaniel Wiehe
*Assistant Examiner* — Eldon Brockman
(74) *Attorney, Agent, or Firm* — Morrison & Foerster LLP

(57) ABSTRACT

An annular nozzle for a ceiling fan includes an inner wall defining a bore having a bore axis, an outer wall extending about the inner wall, an air inlet for receiving an air flow, and an air outlet section extending between the inner wall and the outer wall. The air outlet section defines an air outlet for emitting the air flow. An interior passage extends about the bore axis for conveying the air flow to the air outlet. The air outlet section is configured to emit the air flow away from the bore axis.

19 Claims, 11 Drawing Sheets

(56) References Cited

U.S. PATENT DOCUMENTS

| | | | | |
|---|---|---|---|---|
| 5,913,334 | A | 6/1999 | Hyun | |
| 6,123,618 | A | 9/2000 | Day | |
| 6,379,113 | B1 | 4/2002 | Kim | |
| 7,507,074 | B2 | 3/2009 | Munshi et al. | |
| 8,128,057 | B2 | 3/2012 | Swinford | |
| 8,152,453 | B2 | 4/2012 | Oleson | |
| 2005/0092888 | A1 | 5/2005 | Gonce | |
| 2007/0166179 | A1 | 7/2007 | Pace | |
| 2007/0183899 | A1 | 8/2007 | Munshi et al. | |
| 2008/0296459 | A1 | 12/2008 | Frampton et al. | |
| 2009/0060711 | A1* | 3/2009 | Gammack et al. | 415/90 |
| 2009/0072108 | A1 | 3/2009 | Oleson | |
| 2012/0163972 | A1 | 6/2012 | Dyson et al. | |
| 2013/0017104 | A1 | 1/2013 | Stewart et al. | |
| 2013/0017105 | A1 | 1/2013 | Stewart et al. | |
| 2013/0017106 | A1 | 1/2013 | Stewart et al. | |
| 2013/0302146 | A1 | 11/2013 | Dyson et al. | |
| 2013/0336771 | A1 | 12/2013 | Dyson et al. | |
| 2014/0199185 | A1 | 7/2014 | Nicolas et al. | |
| 2014/0199186 | A1 | 7/2014 | Nicolas et al. | |

FOREIGN PATENT DOCUMENTS

| | | |
|---|---|---|
| CN | 101713414 | 5/2010 |
| CN | 101842036 | 9/2010 |
| CN | 101852214 | 10/2010 |
| CN | 201627736 | 11/2010 |
| CN | 101936310 | 1/2011 |
| CN | 102003420 | 4/2011 |
| CN | 201874898 | 6/2011 |
| CN | 201884344 | 6/2011 |
| CN | 202165333 | 3/2012 |
| CN | 202381366 | 8/2012 |
| CN | 202646062 | 1/2013 |
| DE | 880 923 | 10/1952 |
| DE | 1 291 090 | 3/1969 |
| DE | 20 2012 002 443 | 6/2012 |
| EP | 0 772 007 | 5/1997 |
| GB | 1065644 | 4/1967 |
| GB | 1 447 523 | 8/1976 |
| GB | 2 049 161 | 12/1980 |
| GB | 2 452 490 | 3/2009 |
| GB | 2 452 593 | 3/2009 |
| GB | 2464736 | 4/2010 |
| GB | 2468312 | 9/2010 |
| GB | 2468313 | 9/2010 |
| GB | 2468314 | 9/2010 |
| GB | 2468324 | 9/2010 |
| GB | 2468498 | 9/2010 |
| GB | 2492962 | 1/2013 |
| JP | 35-4369 | 3/1960 |
| JP | 56-167897 | 12/1981 |
| JP | 63-79492 | 5/1988 |
| JP | 63-150234 | 10/1988 |
| JP | 64-21300 | 2/1989 |
| JP | 3-156232 | 7/1991 |
| JP | 7-190443 | 7/1995 |
| JP | 11-5631 | 1/1999 |
| JP | 2009-62986 | 3/2009 |
| JP | 2009-209934 | 9/2009 |
| JP | 2010-138906 | 6/2010 |
| JP | 2010-203449 | 9/2010 |
| JP | 2010-203454 | 9/2010 |
| JP | 2012-132460 | 7/2012 |
| WO | WO-2009/038988 | 3/2009 |
| WO | WO-2009/074834 | 6/2009 |
| WO | WO-2010/100462 | 9/2010 |

OTHER PUBLICATIONS

Dyson et al., U.S. Office Action mailed Aug. 29, 2014, directed to U.S. Appl. No. 13/327,149; 15 pages.

Stewart et al., U.S. Office Action mailed Sep. 11, 2014, directed to U.S. Appl. No. 13/547,736; 10 pages.

Stewart et al., U.S. Office Action mailed Sep. 4, 2014, directed to U.S. Appl. No. 13/547,794; 14 pages.

* cited by examiner

FAN

REFERENCE TO RELATED APPLICATIONS

This application claims the priority of United Kingdom Application No. 1021911.1, filed Dec. 23, 2010, the entire contents of which are incorporated herein by reference.

FIELD OF THE INVENTION

The present invention relates to a nozzle for a ceiling fan for generating an air flow within a room, and to a ceiling fan including such as a nozzle.

BACKGROUND OF THE INVENTION

A number of ceiling fans are known. A standard ceiling fan comprises a set of blades mounted about a first axis and a drive also mounted about the first axis for rotating the set of blades. Another type of ceiling fan generates a column of air downwardly into a room. For example, GB 2,049,161 describes a ceiling fan which has a domed support which is suspended from a ceiling, and a motor-driven impeller which is coupled to the inner surface of the support. An air stream emitted from the impeller is conveyed through a generally cylindrical body containing an array of air passages to generate a linear air stream which is emitted from the ceiling fan.

SUMMARY OF THE INVENTION

In a first aspect the present invention provides an annular nozzle for a ceiling fan, the nozzle comprising an inner wall defining a bore having a bore axis, an outer wall extending about the inner wall, an air inlet, an air outlet section extending between the inner wall and the outer wall, the air outlet section comprising at least one air outlet, and an interior passage extending about the bore axis for conveying an air flow to the air outlet section, wherein the air outlet section is configured to emit the air flow away from the bore axis.

The air flow emitted from the annular nozzle entrains air surrounding the nozzle, which thus acts as an air amplifier to supply both the emitted air flow and the entrained air to the user. The entrained air will be referred to here as a secondary air flow. The secondary air flow is drawn from the room space, region or external environment surrounding the nozzle. The emitted air flow combines with the entrained secondary air flow to form a combined, or total, air flow projected forward from the nozzle. A portion of the secondary air flow is drawn through the bore of the nozzle, whereas other portions of the secondary air flow pass around the outside of the outer wall and in front of the nozzle to combine with the emitted air flow downstream of the bore.

The inner wall is preferably annular in shape to extend about and define the bore. The interior passage is preferably located between the inner wall and the outer wall, and more preferably is defined, at least in part, by the inner wall and the outer wall. The nozzle comprises at least one air inlet for receiving an air flow. The outer wall preferably defines the air inlet(s). For example, the, or each air inlet may be in the form of an aperture formed in the outer wall. The nozzle comprises an air outlet section extending between the inner wall and the outer wall. The air outlet section may be a separate component connected between the inner wall and the outer wall. Alternatively, at least part of the air outlet section may be integral with one of the inner wall and the outer wall. The air outlet section preferably forms at least part of an end wall, more preferably a lower end wall, of the nozzle. The air outlet section defines, at least in part, at least one air outlet of the nozzle for emitting the air flow. The air outlet(s) may be formed in the air outlet section. Alternatively, the air outlet(s) may be located between the air outlet section and one of the inner wall and the outer wall. The air inlet(s) of the nozzle are preferably substantially orthogonal to the air outlet(s) of the nozzle.

The air outlet section is configured to emit the air flow away from the bore axis, preferably in the shape of an outwardly tapering cone. The inventors have found that the emission of the air flow from the nozzle in a direction which extends away from the bore axis can increase the degree of the entrainment of the secondary air flow by the emitted air flow, and thus increase the flow rate of the combined air flow generated by the fan. References herein to absolute or relative values of the flow rate, or the maximum velocity, of the combined air flow are made in respect of those values as recorded at a distance of three times the diameter of the air outlet of the nozzle.

Without wishing to be bound by any theory, the inventors consider that the rate of entrainment of the secondary air flow may be related to the magnitude of the surface area of the outer profile of the air flow emitted from the nozzle. When the emitted air flow is outwardly tapering, or flared, the surface area of the outer profile is relatively high, promoting mixing of the emitted air flow and the air surrounding the nozzle and thus increasing the flow rate of the combined air flow. Increasing the flow rate of the combined air flow generated by the nozzle has the effect of decreasing the maximum velocity of the combined air flow. This can make the nozzle suitable for use with a fan for generating a flow of air through a room or an office.

The air outlet section preferably comprises an inner section connected to the inner wall, and an outer section connected to the outer wall. The at least one air outlet may be located between the inner section and the outer section of the annular wall. At least part of the inner section may taper away from the bore axis. An angle of inclination of this part of the inner section to the bore axis may be between 0 and 45°. This part of the inner section preferably has a shape which is substantially conical. The air outlet section may be arranged to emit the air flow in a direction which is substantially parallel to this part of the inner section. The outer section is preferably substantially orthogonal to the bore axis.

The at least one air outlet preferably extends about the bore axis. The nozzle may comprise a plurality of air outlets angularly spaced about the bore axis, but in a preferred embodiment the nozzle comprises a substantially annular air outlet.

The at least one air outlet may be shaped to emit air in a direction extending away from the bore axis. A portion of the interior passage which is located adjacent the air outlet may be shaped to direct the air flow through the air outlet so that the emitted air flow is directed away from the bore axis. To facilitate manufacturing, the air outlet section may comprise an air channel for directing the air flow through the air outlet. The air channel is preferably inclined to the bore axis, and preferably has a shape which is generally frusto-conical. An angle subtended between the air channel and the bore axis is preferably between 0 and 45°. In a preferred embodiment, this angle is around 15°. The interior passage preferably extends about the bore axis, and preferably surrounds the bore axis. The interior passage may have any desired cross-section in a plane passing through the bore axis. In a preferred embodiment the interior passage has a substantially rectangular cross-section in a plane passing through the bore axis.

The nozzle may comprise a chord line extending midway between the inner wall and the outer wall of the nozzle. The at least one air outlet is preferably located between the bore axis and the chord line.

In a second aspect the present invention provides a ceiling fan comprising a system for generating an air flow and an annular nozzle as aforementioned for emitting the generated air flow. The system for creating an air flow is preferably located in an air inlet section of the fan. The air inlet section is preferably connected to the outer wall of the nozzle. The air inlet section preferably comprises an inlet, and the system for creating an air flow comprises an impeller, and a motor for rotating the impeller about an impeller axis to draw an air flow through the inlet of the air inlet section. The impeller axis is preferably substantially orthogonal to the bore axis.

The inlet of the air inlet section is preferably arranged so that the impeller axis passes through the inlet, more preferably so that the impeller axis is substantially orthogonal to the inlet of the air inlet section.

To minimize the size of the air inlet section, the impeller is preferably an axial flow impeller. The air inlet section preferably comprises a diffuser located downstream from the impeller for guiding the air flow towards the nozzle. The air inlet section preferably comprises an outer casing, a shroud extending about the motor and the impeller, and a mounting arrangement for mounting the shroud within the outer casing. The mounting arrangement may comprise a plurality of mounts located between the outer casing and the shroud, and a plurality of resilient elements connected between the mounts and shroud. In addition to positioning the shroud relative to the outer casing, preferably so that the shroud is substantially co-axial with the outer casing, the resilient elements can absorb vibrations generated during use of the fan. The resilient elements are preferably held in a state of tension between the mounts and the shroud, and preferably comprise a plurality of tension springs each connected at one end to the shroud and at another end to one of the supports. A mechanism may be provided for urging apart the ends of the tension springs in order to maintain the springs in a state of tension. For example, the mounting arrangement may comprise a spacer ring which is located between the mounts for urging apart the mounts, and thereby urging one end of each spring away from the other end.

The fan preferably comprises a support assembly for supporting the nozzle on a ceiling of a room. The support assembly preferably comprises a mounting bracket which is attachable to the ceiling of the room. This mounting bracket may be in the form of a plate which is attachable to the ceiling, for example using screws. The support assembly is preferably configured to support the air inlet section and the nozzle so that the impeller axis is at an angle of less than 90° to the mounting bracket, more preferably so that the impeller axis is at an angle of less than 45° to the mounting bracket. In one embodiment, the support assembly is configured to support the air inlet section and the nozzle so that the impeller axis is substantially parallel to the mounting bracket. The bore axis is preferably substantially orthogonal to the impeller axis, and so the support assembly may be configured to support the air inlet section and the nozzle so that the axis of the bore is substantially orthogonal to the mounting bracket. The air inlet section and the nozzle preferably have substantially the same depth as measured along the bore axis.

This can allow the fan to be arranged so that it lies substantially parallel to a horizontal ceiling to which the mounting bracket is attached. The nozzle may be located relatively close to the ceiling, reducing the risk of a user, or an item being carried by the user, coming into contact with the nozzle.

The air inlet section may be located between the support assembly and the nozzle. One end of the air inlet section is preferably connected to the support assembly, with the other end of the air inlet section being connected to the nozzle. The air inlet section is preferably substantially cylindrical. Each of the shroud and the outer casing may be substantially cylindrical. The support assembly may comprise an air passage for conveying air to the inlet of the air inlet section. The air passage of the support assembly is preferably substantially co-axial with an air passage of the air inlet section which houses the impeller and the motor.

The nozzle is preferably rotatable relative to the support assembly to allow a user to change the direction in which the air flow is emitted into a room. The nozzle is preferably rotatable relative to the support assembly about a rotational axis and between a first orientation in which the air flow is directed away from the ceiling and a second orientation in which the air flow is directed towards the ceiling. For example, during the summer the user may wish to orient the nozzle so that the air flow is emitted away from a ceiling to which the fan is attached and into a room so that the air flow generated by the fan provides a relatively cool breeze for cooling a user located beneath the fan. During the winter however, the user may wish to invert the nozzle through 180° so that the air flow is emitted towards the ceiling to displace and circulate warm air which has risen to the upper portions of the walls of the room, without creating a breeze directly beneath the fan.

The nozzle may be inverted as it is rotated between the first orientation and the second orientation. The rotational axis of the nozzle is preferably substantially orthogonal to the bore axis, and is preferably substantially co-linear with the impeller axis.

The nozzle may be rotatable relative to both the air inlet section and the support assembly. Alternatively, the air inlet section may be connected to the support assembly so that both the air inlet section and the nozzle are rotatable relative to the support assembly.

The nozzle may be pivotable relative to at least part of the support assembly. The support assembly preferably comprises a ceiling mount for mounting the fan on a ceiling, an arm having a first end connected to the ceiling mount, and a body connected to a second end of the arm and to the nozzle. The second end of the arm may be connected directly to the nozzle, or it may be connected to the air inlet section. The body is preferably an annular body including the air passage. The body is preferably pivotable relative to the arm to move the nozzle between a raised position and a lowered position. Lowering the nozzle can increase the distance between the nozzle and a ceiling to which the fan is attached, and so allow the nozzle to be rotated relative to the support assembly without coming into contact with the ceiling. Lowering the nozzle can also facilitate its rotation by the user.

The nozzle is preferably pivotable relative to part of the support assembly about a pivot axis which is substantially orthogonal to the impeller axis. The pivot axis is preferably substantially orthogonal to the bore axis of the nozzle. The impeller axis is preferably substantially horizontal when the nozzle is in the raised position and the support assembly is connected to a substantially horizontal ceiling.

The nozzle may be pivotable about an angle in the range from 5 to 45° to move from the raised position to the lowered position. Depending on the radius of the outer wall of the nozzle, the nozzle may pivot about an angle in the range from 10 to 20° as it moves from the raised position to the lowered position. The support assembly preferably houses a releasable locking mechanism for maintaining the nozzle in its raised position. The locking mechanism is releasable by the user to allow the nozzle to be moved to its lowered position. The locking mechanism is preferably biased towards a locking configuration for locking the body relative to the arm so that the nozzle is maintained in its raised position. The locking mechanism is preferably arranged to return automatically to the locking configuration when the nozzle is moved from the lowered position to the raised position.

The arm is preferably rotatably connected to the ceiling mount. The arm is preferably rotatable relative to the ceiling mount about a rotational axis, and the arm is preferably inclined to the rotational axis. Consequently, as the arm is rotated about its rotational axis, the nozzle and the air inlet section orbit about the rotational axis. This allows the nozzle to be moved to a desired position within a relatively wide annular area. The arm is preferably inclined at an angle in the range from 45 to 75° to the rotational axis to minimize the distance between the nozzle and the ceiling. The rotational axis of the arm is preferably substantially orthogonal to the pivot axis of the body.

In a third aspect the present invention provides a ceiling fan comprising an air inlet section having an air inlet, an impeller and a motor for rotating the impeller about an impeller axis to draw an air flow through the air inlet, and an annular nozzle for receiving the air flow from the air inlet section, the nozzle comprising an inner wall defining a bore having a bore axis which is substantially orthogonal to the impeller axis, an outer wall extending about the inner wall, an air outlet section extending between the inner wall and the outer wall, the air outlet section comprising at least one air outlet for emitting the air flow, and an interior passage extending about the bore axis for conveying the air flow to the air outlet section, wherein the air outlet section is configured to emit the air flow away from the bore axis.

Features described above in connection with the first aspect of the invention are equally applicable to each of the second and third aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

FIGS. 1 to 5 illustrate a fan assembly for generating an air flow within a room. In this example, the fan assembly is in the form of a ceiling fan 10 which is connectable to a ceiling C of a room. The ceiling fan 10 comprises an air inlet section 12 for generating the air flow, an annular nozzle 14 for emitting the air flow, and a support assembly 16 for supporting the air inlet section 12 and the nozzle 14 on the ceiling C of the room.

Figure 1:
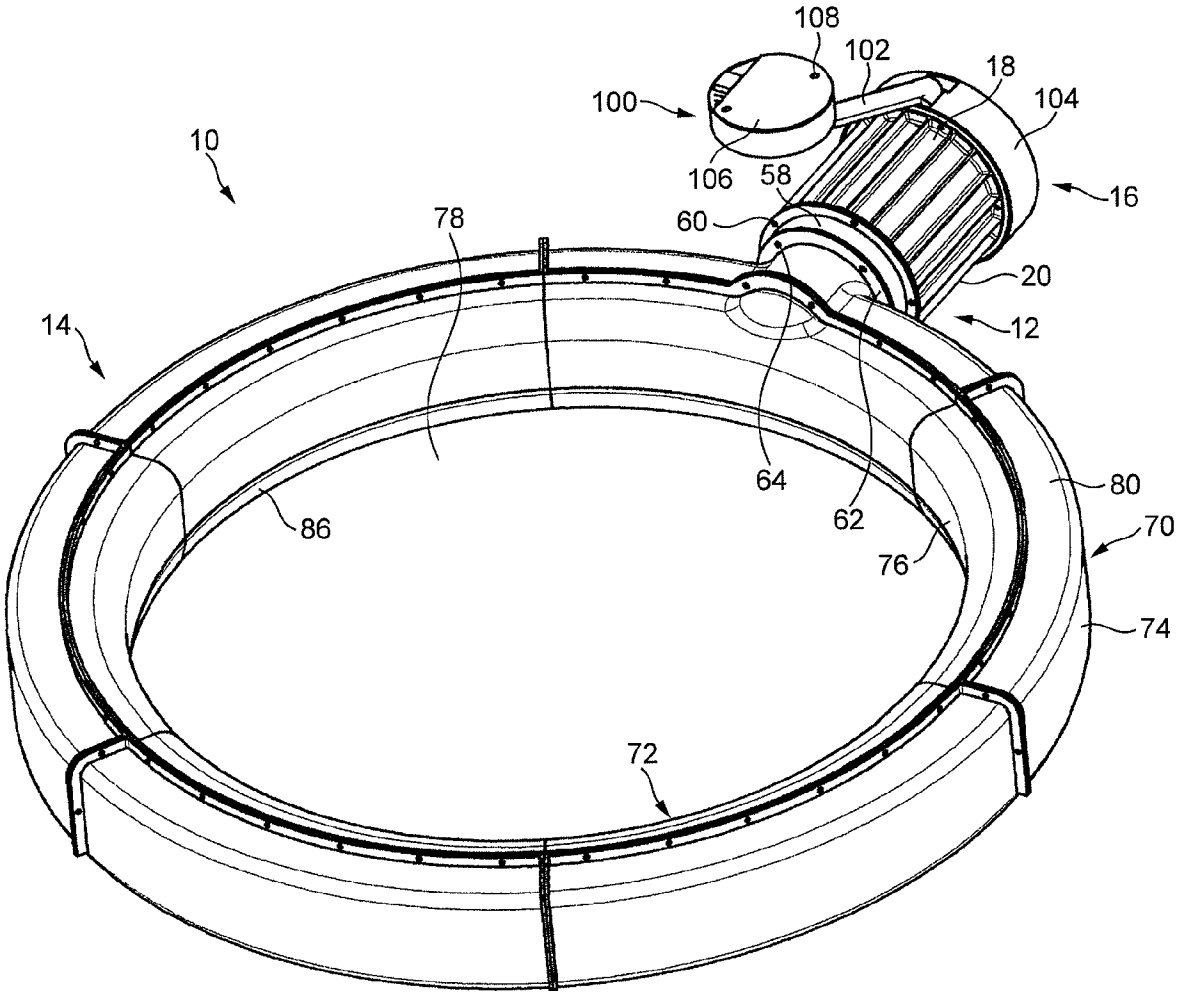
FIG. 1 is a front perspective view, from above, of a ceiling fan.
Figure 2:
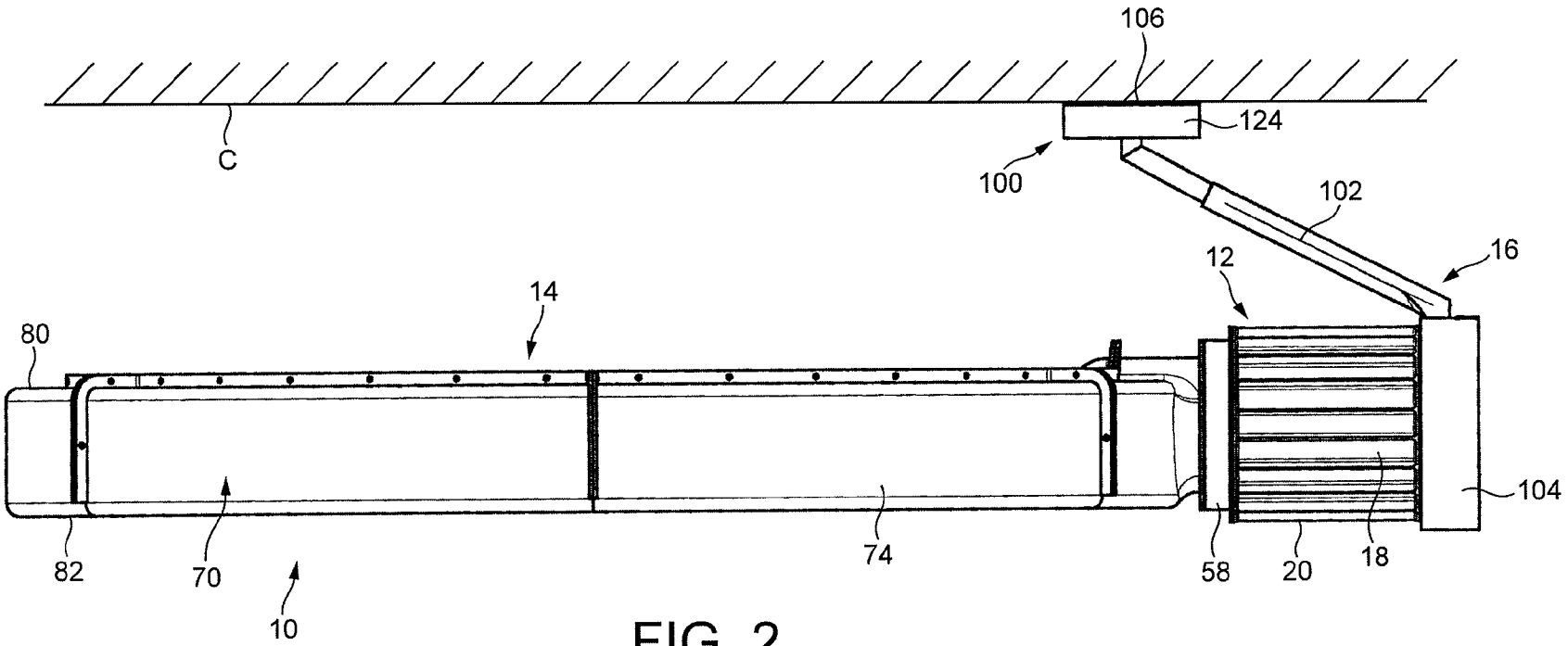
FIG. 2 is a left side view of the ceiling fan mounted to a ceiling, and with an annular nozzle of the ceiling fan in a raised position.
Figure 3:
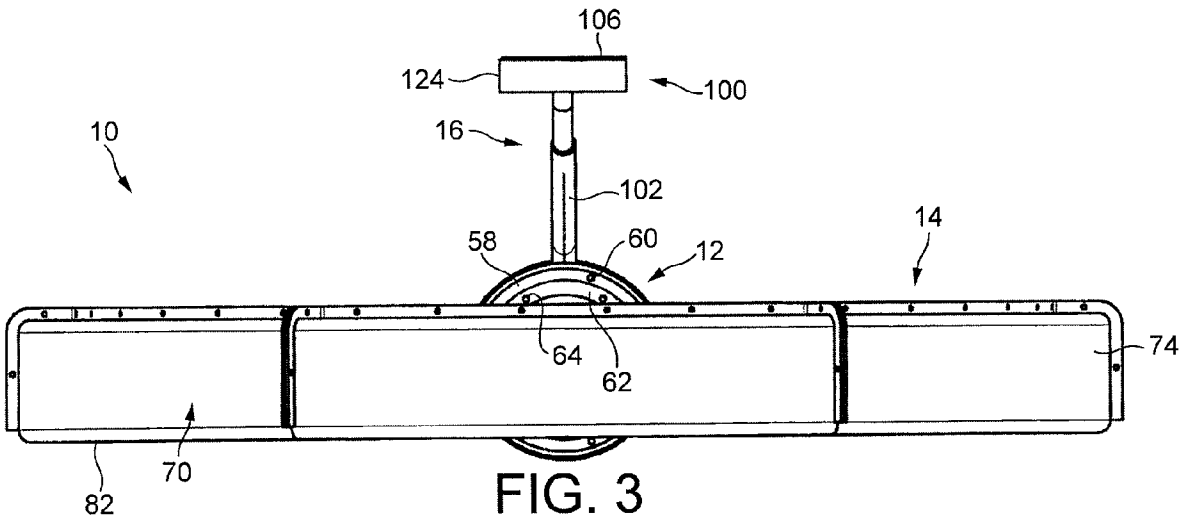
FIG. 3 is a front view of the ceiling fan.
Figure 4:
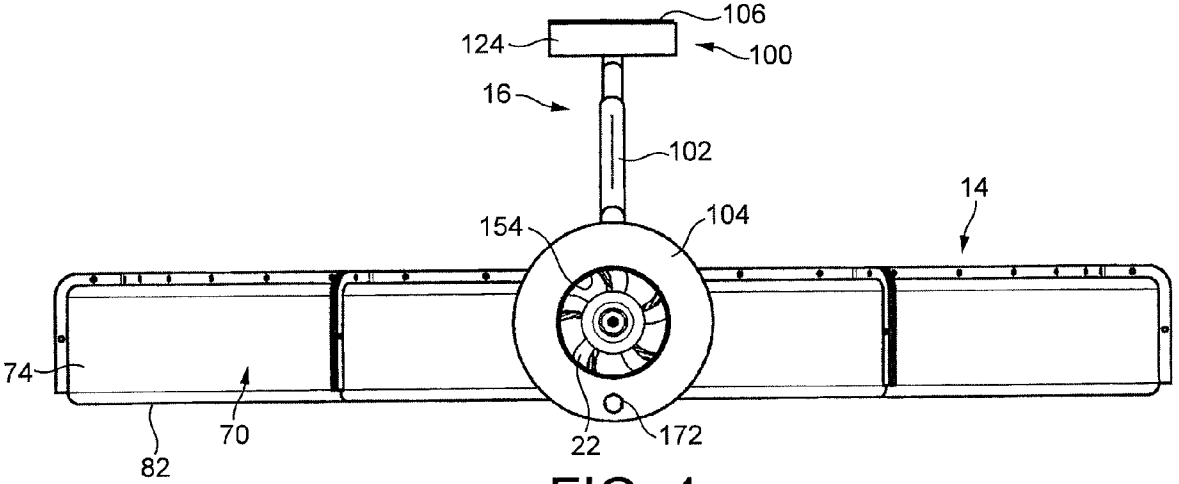
FIG. 4 is a rear view of the ceiling fan.
Figure 5:
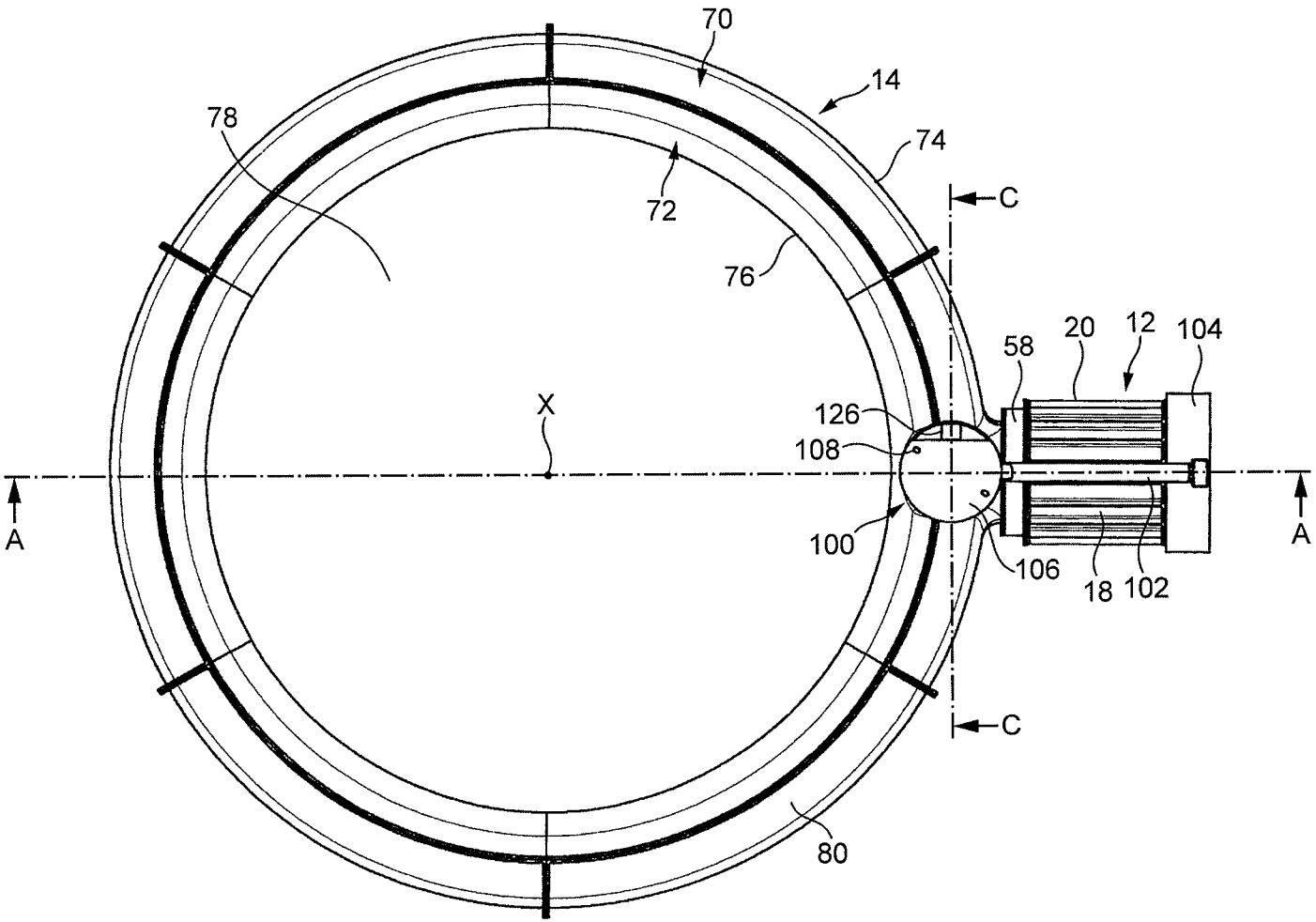
FIG. 5 is a top view of the ceiling fan.

The air inlet section 12 comprises a generally cylindrical outer casing 18 which houses a system for generating a primary air flow which is emitted from the nozzle 14. As indicated in FIGS. 1, 2 and 5, the outer casing 18 may be formed with a plurality of axially extending reinforcing ribs 20 which are spaced about the longitudinal axis L of the outer casing 18, but these ribs 20 may be omitted depending on the strength of the material from which the outer casing 18 is formed.

Figure 6:
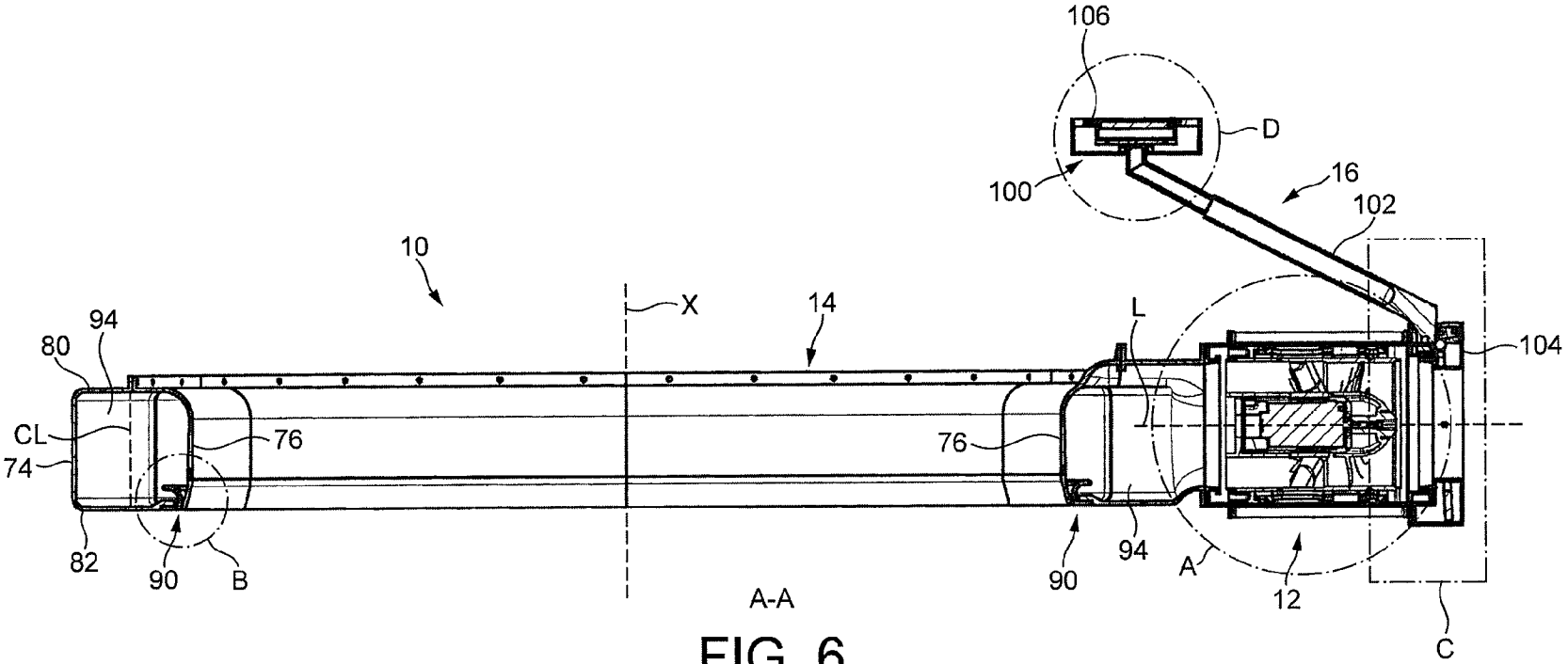
FIG. 6 is a side sectional view of the ceiling fan, taken along line A-A in FIG. 5.
Figure 7:
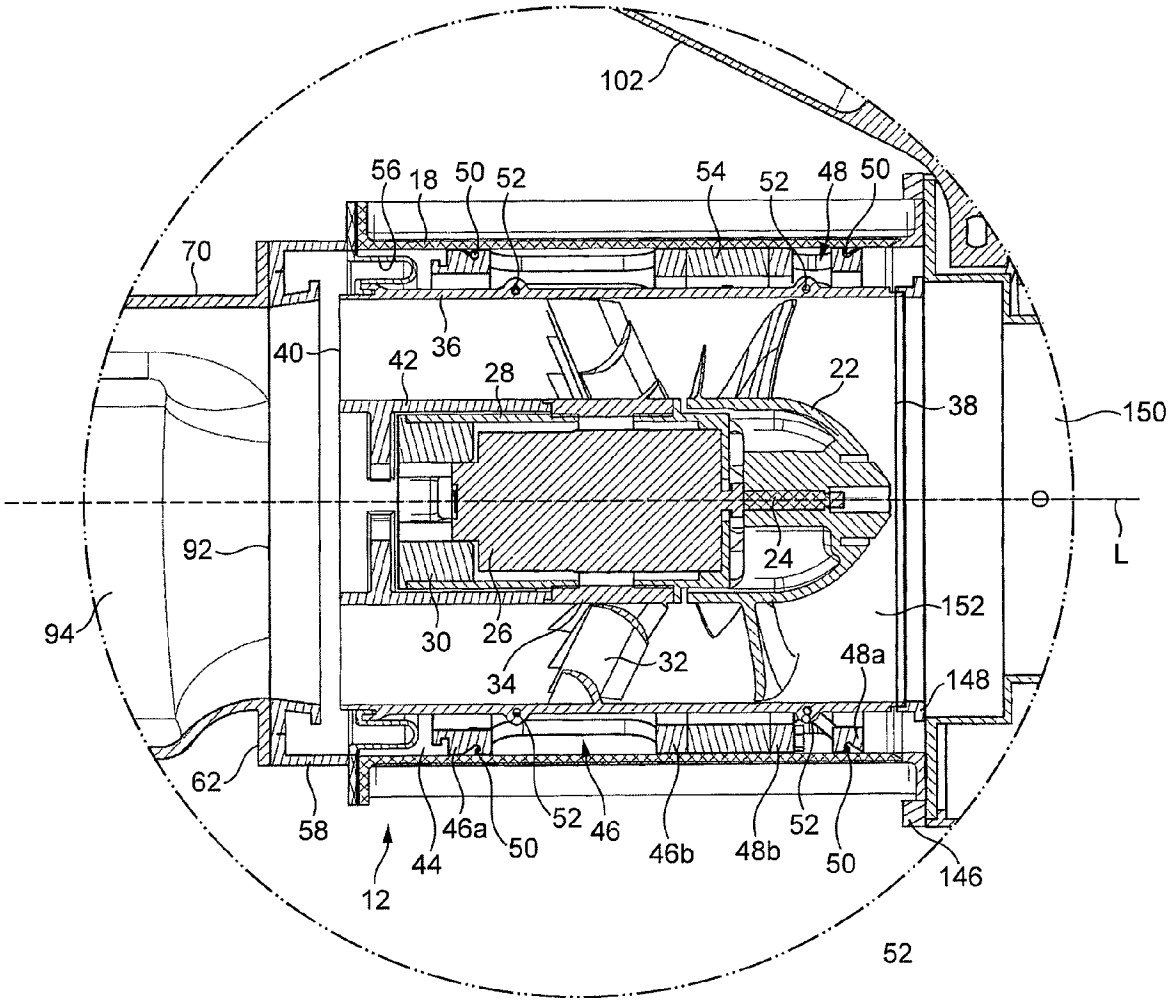
FIG. 7 is a close up view of area A indicated in FIG. 6, illustrating the motor and impeller of an air inlet section of the ceiling fan.

With reference now to FIGS. 6 and 7, the air inlet section 12 houses an impeller 22 for drawing a primary air flow into the ceiling fan 10. The impeller 22 is in the form of an axial flow impeller which is rotatable about an impeller axis which is substantially co-linear with the longitudinal axis L of the outer casing 18. The impeller 22 is connected to a rotary shaft 24 extending outwardly from a motor 26. In this embodiment, the motor 26 is a DC brushless motor having a speed which is variable by a control circuit (not shown) located within the support assembly 16. The motor 26 is housed within a motor casing comprising a front motor casing section 28 and a rear motor casing section 30. During assembly, the motor 26 is inserted first into the front motor casing section 28, and the rear motor casing section 30 is inserted subsequently into the front casing section 28 to both retain and support the motor 26 within the motor casing.

The air inlet section 12 also houses a diffuser located downstream from the impeller 22. The diffuser comprises a plurality of diffuser vanes 32 which are located between an inner cylindrical wall 34 and an outer cylindrical wall of the diffuser. The diffuser is preferably molded as a single body, but alternatively the diffuser may be formed from a plurality of parts or sections which are connected together. The inner cylindrical wall 34 extends about and supports the motor casing. The outer cylindrical wall provides a shroud 36 which extends about the impeller 22 and the motor casing. In this example, the shroud 36 is substantially cylindrical. The shroud 36 comprises an air inlet 38 at one end thereof through which the primary air flow enters the air inlet section 12 of the ceiling fan 10, and an air outlet 40 at the other end thereof through which the primary air flow is exhausted from the air inlet section 12 of the ceiling fan 10. The impeller 22 and the shroud 36 are shaped so when the impeller 22 and motor casing are supported by the diffuser, the blade tips of the impeller 22 are in close proximity to, but do not contact, the inner surface of the shroud 36 and the impeller 22 is substantially co-axial with the shroud 36. A cylindrical guide member 42 is connected to the rear of the inner cylindrical wall 34 of the diffuser for guiding the primary air flow generated by the rotation of the impeller 22 towards the air outlet 40 of the shroud 36.

The air inlet section 12 comprises a mounting arrangement for mounting the diffuser within the outer casing 18 so that the impeller axis is substantially co-linear with the longitudinal axis L of the outer casing 18. The mounting arrangement is located within an annular channel 44 extending between the outer casing 18 and the shroud 36. The mounting arrangement comprises first mount 46 and a second mount 48 which is axially spaced along the longitudinal axis L from the first mount 46. The first mount 46 comprises a pair of interconnected arcuate members 46*a*, 46*b* which are mutually axially spaced along the longitudinal axis L. The second mount 48 similarly comprises a pair of interconnected arcuate members 48*a*, 48*b* which are mutually axially spaced along the longitudinal axis L. An arcuate member 46*a*, 48*a* of each mount 46, 48 comprises a plurality of spring connectors 50, each of which is connected to one end of a respective tension spring (not shown). In this example, the mounting arrangement comprises four tension springs, with each of these arcuate members 46*a*, 48*a* comprising two diametrically opposed connectors 50. The other end of each tension spring is connected to a respective spring connector 52 formed in the shroud 36. The mounts 46, 48 are urged apart by an arcuate spacer ring 54 inserted into the annular channel 44 between the mounts 46, 48 so that the tension springs are held in a state of tension between the connectors 50, 52. This serves to maintain a regular spacing between the shroud 36 and the mounts 46, 48 while allowing a degree of radial movement of the shroud 36 relative to the mounts 46, 48 to reduce the transmission of vibrations from the motor casing to the outer casing 18. A flexible seal 56 is provided at one end of the annular channel 44 to prevent part of the primary air flow from returning to the air inlet 40 of the shroud 36 along the annular channel 44.

An annular mounting bracket 58 is connected to the end of the outer casing 18 which extends about the air outlet 42 of the shroud 36, for example by means of bolts 60. An annular flange 62 of the nozzle 14 of the ceiling fan 10 is connected to the mounting bracket 58, for example, by means of bolts 64. Alternatively, the mounting bracket 58 may be integral with the nozzle 14.

Returning to FIGS. 1 to 5, the nozzle 14 comprises an outer section 70 and an inner section 72 connected to the outer section 70 at the upper end (as illustrated) of the nozzle. The outer section 70 comprises a plurality of arcuate sections which are connected together to define an outer side wall 74 of the nozzle 14. The inner section 72 similarly comprises a plurality of arcuate sections which are each connected to a respective section of the outer section 70 to define an annular inner side wall 76 of the nozzle 14. The outer wall 74 extends about the inner wall 76. The inner wall 76 extends about a central bore axis X to define a bore 78 of the nozzle. The bore axis X is substantially orthogonal to the longitudinal axis L of the outer casing 18. The bore 78 has a generally circular cross-section which varies in diameter along the bore axis X. The nozzle also comprises an annular upper wall 80 which extends between one end of the outer wall 74 and one end of the inner wall 76, and an annular lower wall 82 which extends between the other end of the outer wall 74 and the other end of the inner wall 76. The inner section 70 is connected to the outer section 72 substantially midway along the upper wall 80, whereas the outer section 72 of the nozzle forms the majority of the lower wall 82.

Figure 8:
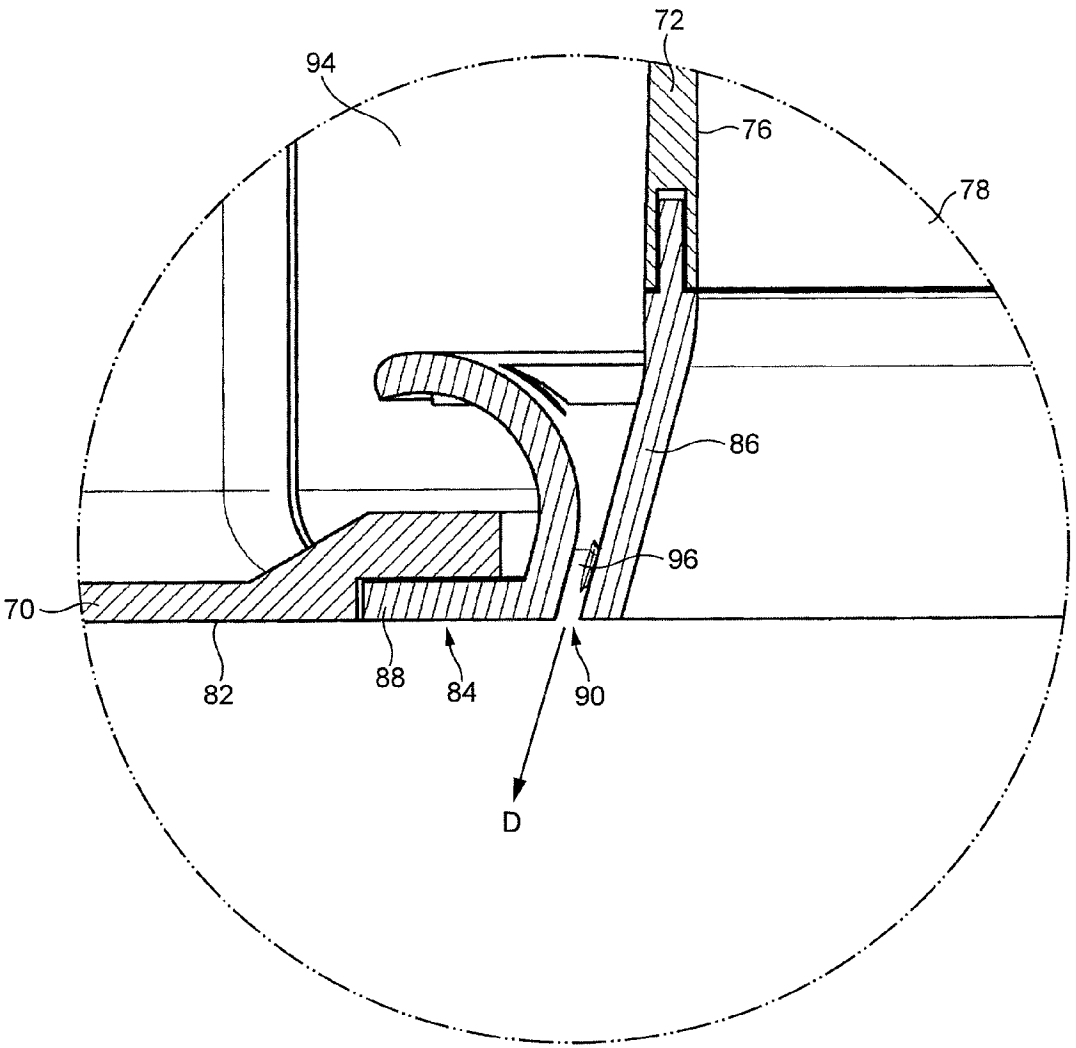
FIG. 8 is a close up view of area B indicated in FIG. 6, illustrating the air outlet of the annular nozzle.

With particular reference to FIG. 8, the nozzle 14 also comprises an annular air outlet section 84. The outlet section 84 comprises an inner, generally frusto-conical inner section 86 which is connected to the lower end of the inner wall 76. The inner section 86 tapers away from the bore axis X. In this embodiment, an angle subtended between the inner section 86 and the bore axis X is around 15°. The outlet section 84 also comprises an annular outer section 88 which is connected to the lower end of the outer section 70 of the nozzle 14, and which defines part of the annular lower wall 82 of the nozzle. The inner section 86 and the outer section 88 of the outlet section 84 are connected together by a plurality of webs (not shown) which serve to control the spacing between the inner section 86 and the outer section 88 about the bore axis X. The outlet section 84 may be formed as a single body, but it may be formed as a plurality of components which are connected together. Alternatively, the inner section 86 may be integral with the inner section 70 and the outer section 88 may be integral with the outer section 72. In this case, one of the inner section 86 and the outer section 88 may be formed with a plurality of spacers for engaging the other one of the inner section 86 and the outer section 88 to control the spacing between the inner section 86 and the outer section 88 about the bore axis X.

The inner wall 76 may be considered to have a cross-sectional profile in a plane containing the bore axis X which is in the shape of part of a surface of an airfoil. This airfoil has a leading edge at the upper wall 80 of the nozzle, a trailing edge at the lower wall 82 of the nozzle, and a chord line CL extending between the leading edge and the trailing edge. In this embodiment, the chord line CL is generally parallel to the bore axis X.

An air outlet 90 of the nozzle 14 is located between the inner section 86 and the outer section 88 of the outlet section 84. The air outlet 90 may be considered to be located in the lower wall 82 of the nozzle 14, adjacent to the inner wall 76 of the nozzle 14 and thus between the chord line CL and the bore axis X, as illustrated in FIG. 6. The air outlet 90 is preferably in the form of an annular slot. The air outlet 90 is preferably generally circular in shape, and located in a plane which is perpendicular to the bore axis X. The air outlet 90 preferably has a relatively constant width in the range from 0.5 to 5 mm.

The annular flange 62 for connecting the nozzle 14 to the air inlet section 12 is integral with one of the sections of the outer section 70 of the nozzle. The flange 62 may be considered to extend about an air inlet 92 of the nozzle for receiving the primary air flow from the air inlet section 12. This section of the outer section 70 of the nozzle 14 is shaped to convey the primary air flow into an annular interior passage 94 of the nozzle 14. The outer wall 74, inner wall 76, upper wall 80 and lower wall 82 of the nozzle 14 together define the interior passage 94, which extends about the bore axis X. The interior passage 94 has a generally rectangular cross-section in a plane which passes through the bore axis X.

As shown in FIG. 8, the air outlet section 84 comprises an air channel 96 for directing the primary air flow through the air outlet 90. The width of the air channel 96 is substantially the same as the width of the air outlet 90. In this embodiment the air channel 96 extends towards the air outlet 90 in a direction D extending away from the bore axis X so that the air channel 96 is inclined relative to the chord line CL of the airfoil, and to the bore axis X of the nozzle 14.

The angle of inclination of the bore axis X, or the chord line CL, to the direction D may take any value. The angle is preferably in the range from 0 to 45°. In this embodiment the angle of inclination is substantially constant about the bore axis X, and is around 15°. The inclination of the air channel 96 to the bore axis X is thus substantially the same as the inclination of the inner section 86 to the bore axis X.

The primary air flow is thus emitted from the nozzle 14 in a direction D which is inclined to the bore axis X of the nozzle 14. The primary air flow is also emitted away from the inner wall 76 of the nozzle 14. By controlling the shape of the air channel 96 so that the air channel 96 extends away from the bore axis X, the flow rate of the combined air flow generated by the ceiling fan 10 can be increased in comparison to that of the combined air flow generated when the primary air flow is emitted in a direction D which is substantially parallel to the bore axis X, or which is inclined towards the bore axis X. Without wishing to be bound by any theory the inventors consider this to be due to the emission of a primary air flow having an outer profile with a relatively large surface area. In this example, the primary air flow is emitted from the nozzle 14 generally in the shape of an outwardly tapering cone. This increased surface area promotes mixing of the primary air flow with air surrounding the nozzle 14, increasing the entrainment of the secondary air flow by the primary air flow and thereby increasing the flow rate of the combined air flow.

Returning again to FIGS. 1 to 5, the support assembly 16 comprises a ceiling mount 100 for mounting the ceiling fan 10 on a ceiling C, an arm 102 having a first end connected to the ceiling mount 100 and a second end connected to a body 104 of the support assembly 100. The body 104 is, in turn, connected to the air inlet section 12 of the ceiling fan 10.

Figure 9:
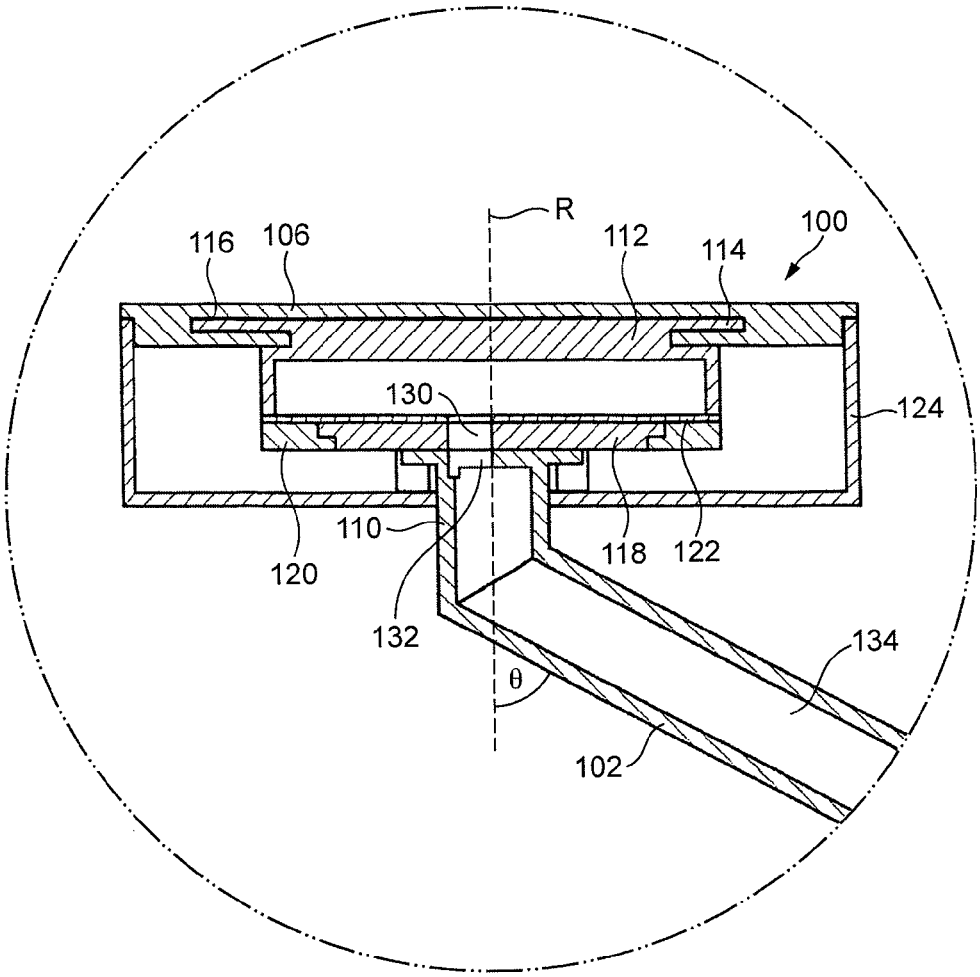
FIG. 9 is a close up view of area D indicated in FIG. 6, illustrating the connection between a ceiling mount and an arm of a support assembly of the ceiling fan.
Figure 10:
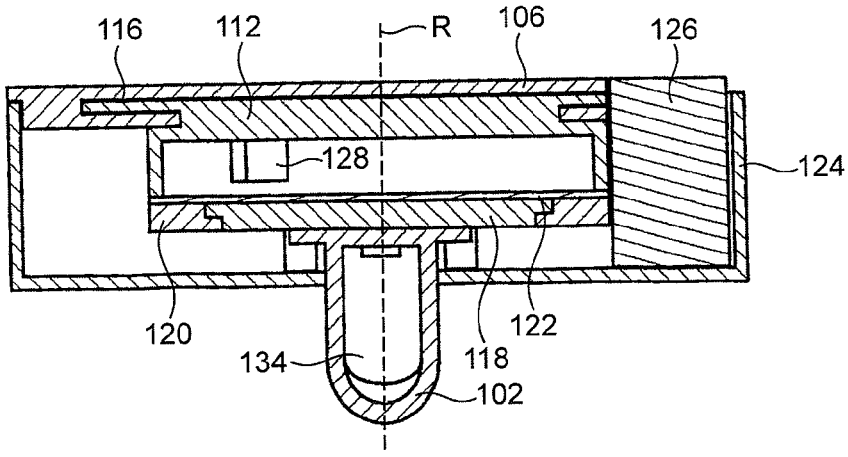
FIG. 10 is a side sectional view of the ceiling mount and the arm of the support assembly, taken along line C-C in FIG. 6.

The ceiling mount 100 comprises a mounting bracket 106 which is connectable to a ceiling C of a room using screws insertable through apertures 108 in the mounting bracket 106. With reference to FIGS. 9 and 10, the ceiling mount 100 further comprises a coupling assembly for coupling a first end 110 of the arm 102 to the mounting bracket 106. The coupling assembly comprises a coupling disc 112 which has an annular rim 114 which is received within an annular groove 116 of the mounting bracket 106 so that the coupling disc 112 is rotatable relative to the mounting bracket 106 about a rotational axis R. The arm 102 is inclined to the rotational axis R by an angle θ which is preferably in the range from 45 to 75°, and in this example is around 60°. Consequently, as the arm 102 is rotated about the rotational axis R, the air inlet section 102 and the nozzle orbit about the rotational axis R.

Figure 11:
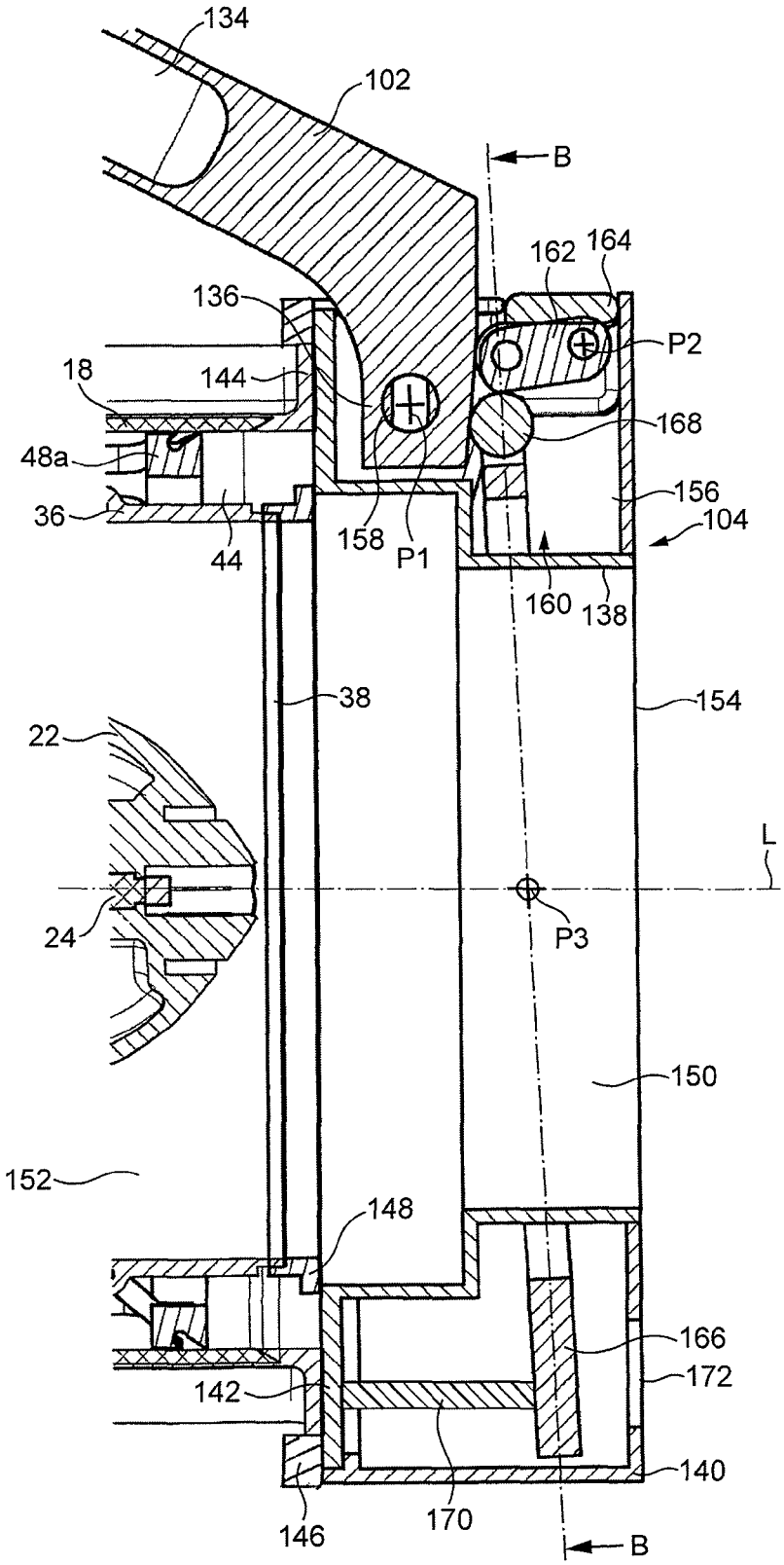
FIG. 11 is a close up view of area C indicated in FIG. 6, illustrating a releasable locking mechanism for retaining the annular nozzle in the raised position.

The first end 110 of the arm 102 is connected to the coupling disc 112 by a number of coupling members 118, 120, 122 of the coupling assembly. The coupling assembly is enclosed by an annular cap 124 which is secured to the mounting bracket 106, and which includes an aperture through which the first end 110 of the arm 102 protrudes. The cap 124 also surrounds an electrical junction box 126 for connection to electrical wires for supplying power to the ceiling fan 10. An electrical cable (not shown) extends from the junction box 126 through apertures 128, 130 formed in the coupling assembly, and aperture 132 formed in the first end 100 of the arm, and into the air 102. As illustrated in FIGS. 9 to 11, the arm 102 is tubular, and comprises a bore 134 extending along the length of the arm 102 and within which the electrical cable extends from the ceiling mount 100 to the body 104.

The second end 136 of the arm 102 is connected to the body 104 of the support assembly 16. The body 104 of the support assembly 16 comprises an annular inner body section 138 and an annular outer body section 140 extending about the inner body section 138. The inner body section 138 comprises an annular flange 142 which engages a flange 144 located on the outer casing 18 of the air inlet section 12. An annular connector 146, for example a C-clip, is connected to the flange 142 of the inner body section 138 so as to extend about and support the flange 144 of the outer casing 18 so that the outer casing 18 is rotatable relative to the inner body section 138 about the longitudinal axis L. An annular inlet seal 148 forms an air-tight seal between the shroud 36 and the flange 142 of the inner body section 138.

The air inlet section 12 and the nozzle 14, which is connected to the outer casing 18 by the mounting bracket 58, are thus rotatable relative to the support assembly 16 about the longitudinal axis L. This allows a user to adjust the orientation of the nozzle 14 relative to the support assembly 16, and thus relative to a ceiling C to which the support assembly 16 is connected. To adjust the orientation of the nozzle relative to the ceiling C, the user pulls the nozzle 14 so that the air inlet section 12 and the nozzle 14 both rotate about the longitudinal axis L. For example, during the summer the user may wish to orient the nozzle 14 so that the primary air flow is emitted away from the ceiling C and into a room so that the air flow generated by the fan provides a relatively cool breeze for cooling a user located beneath the ceiling fan 10. During the winter however, the user may wish to invert the nozzle 14 through 180° so that the primary air flow is emitted towards the ceiling C to displace and circulate warm air which has risen to the upper portions of the walls of the room, without creating a breeze directly beneath the ceiling fan.

In this example, both the air inlet section 12 and the nozzle 14 are rotatable about the longitudinal axis L. Alternatively, the ceiling fan 10 may be arranged so that the nozzle 14 is rotatable relative to the outer casing 18, and thus relative to both the air inlet section 12 and the support assembly 16. For example, the outer casing 18 may be secured to the inner body section 138 by means of bolts or screws, and the nozzle 14 may be secured to the outer casing 18 in such a manner that it is rotatable relative to the outer casing 18 about the longitudinal axis L. In this case, the manner of connection between the nozzle 14 and the outer casing 18 may be similar to that affected between the air inlet section 12 and the support assembly 16 in this example.

Returning to FIG. 11, the inner body section 138 defines an air passage 150 for conveying the primary air flow to the air inlet 38 of the air inlet section 12. The shroud 36 defines an air passage 152 which extends through the air inlet section 12, and the air passage 152 of the support assembly 16 is substantially co-axial with the air passage 150 of the air inlet section 12. The air passage 150 has an air inlet 154 which is orthogonal to the longitudinal axis L.

The inner body section 138 and the outer body section 140 together define a housing 156 of the body 104 of the support assembly 16. The housing 156 may retain a control circuit (not shown) for supplying power to the motor 26. The electrical cable extends through an aperture (not shown) formed in the second end 136 of the arm 102 and is connected to the control circuit. A second electrical cable (not shown) extends from the control circuit to the motor 26. The second electrical cable passes through an aperture formed in the flange 142 of the inner body section 138 of the body 104 and enters the annular channel 44 extending between the outer casing 18 and the shroud 36. The second electrical cable subsequently extends through the diffuser to the motor 26. For example, the second electrical cable may pass through a diffuser vane 32 of the shroud and into the motor casing. A grommet may be located about the second electrical cable to form an air-tight seal with the peripheral surface of an aperture formed in the shroud 36 to inhibit the leakage of air through this aperture. The body 104 may also comprise a user interface which is connected to the control circuit for allowing the user to control the operation of the ceiling fan 10. For example, the user interface may comprise one or more buttons or dials for allowing the user to activate and de-activate the motor 26, and to control the speed of the motor 26. Alternatively, or additionally, the user interface may comprise a sensor for receiving control signals from a remote control for controlling the operation of the ceiling fan 10.

Figure 13:
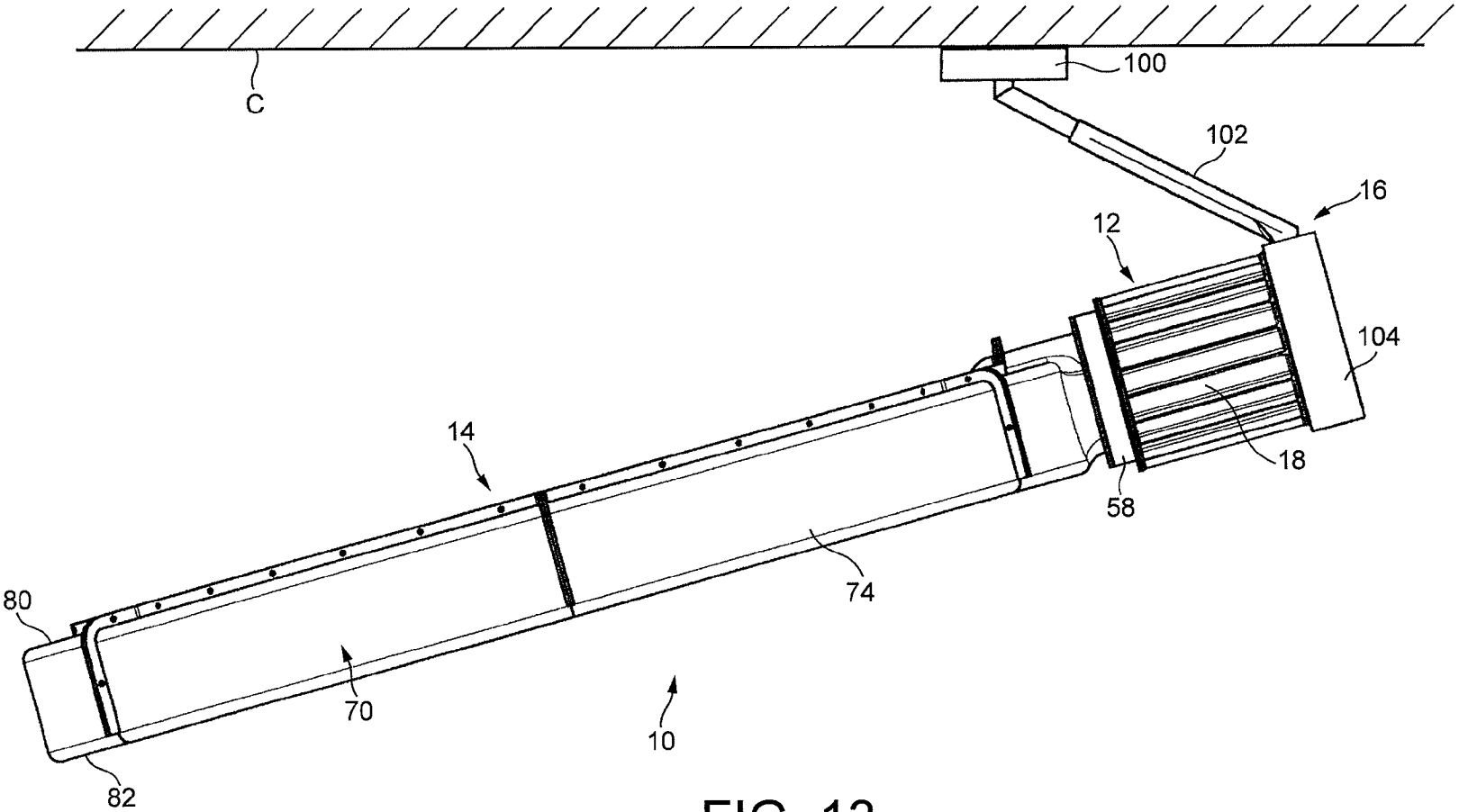
FIG. 13 is a left side view of the ceiling fan mounted to a ceiling, and with an annular nozzle of the ceiling fan in a lowered position.

Depending on the radius of the outer wall 74 of the nozzle 14, the length of the arm 102 and the shape of the ceiling to which the ceiling fan 10 is connected, the distance between the longitudinal axis L of the outer casing 18, about which the nozzle 14 rotates, and the ceiling may be shorter than the radius of the outer wall 74 of the nozzle 14, which would inhibit rotation of the nozzle through 90° about the longitudinal axis L. In order to allow the nozzle to be inverted, the body 104 of the support assembly 16 is pivotable relative to the arm 102 about a first pivot axis P1 to move the nozzle 14 between a raised position, as illustrated in FIG. 2, and a lowered position, as illustrated in FIG. 13. The first pivot axis P1 is illustrated in FIG. 11. The first pivot axis P1 is defined by the longitudinal axis of a pin 158 which extends through the second end 136 of the arm 102, and which has ends retained by the inner body section 138 of the body 104. The first pivot axis P1 is substantially orthogonal to the rotational axis R about which the arm 102 rotates relative to the ceiling mount 100. The first pivot axis P1 is also substantially orthogonal to the longitudinal axis L of the outer casing 18.

In the raised position illustrated in FIG. 2, the longitudinal axis L of the outer casing 18, and thus the impeller axis, is substantially parallel to the mounting bracket 106. This can allow the nozzle 14 to be oriented so that the bore axis X is substantially perpendicular to the longitudinal axis L and to a horizontal ceiling C to which the ceiling fan 10 is attached. In the lowered position, the longitudinal axis L of the outer casing 18, and thus the impeller axis, is inclined to the mounting bracket 106, preferably by an angle of less than 90° and more preferably by an angle of less than 45°. The body 104 may be pivotable relative to the arm 102 about an angle in the range from 5 to 45° to move the nozzle 14 from the raised position to the lowered position. Depending on the radius of the outer wall 74 of the nozzle 14, a pivoting movement about an angle in the range from 10 to 20° may be sufficient to lower the nozzle sufficiently to allow the nozzle to be inverted without contacting the ceiling. In this example, the body 104 is pivotable relative to the arm 102 about an angle of around 12 to 15° to move the nozzle 14 from the raised position to the lowered position.

Figure 12:
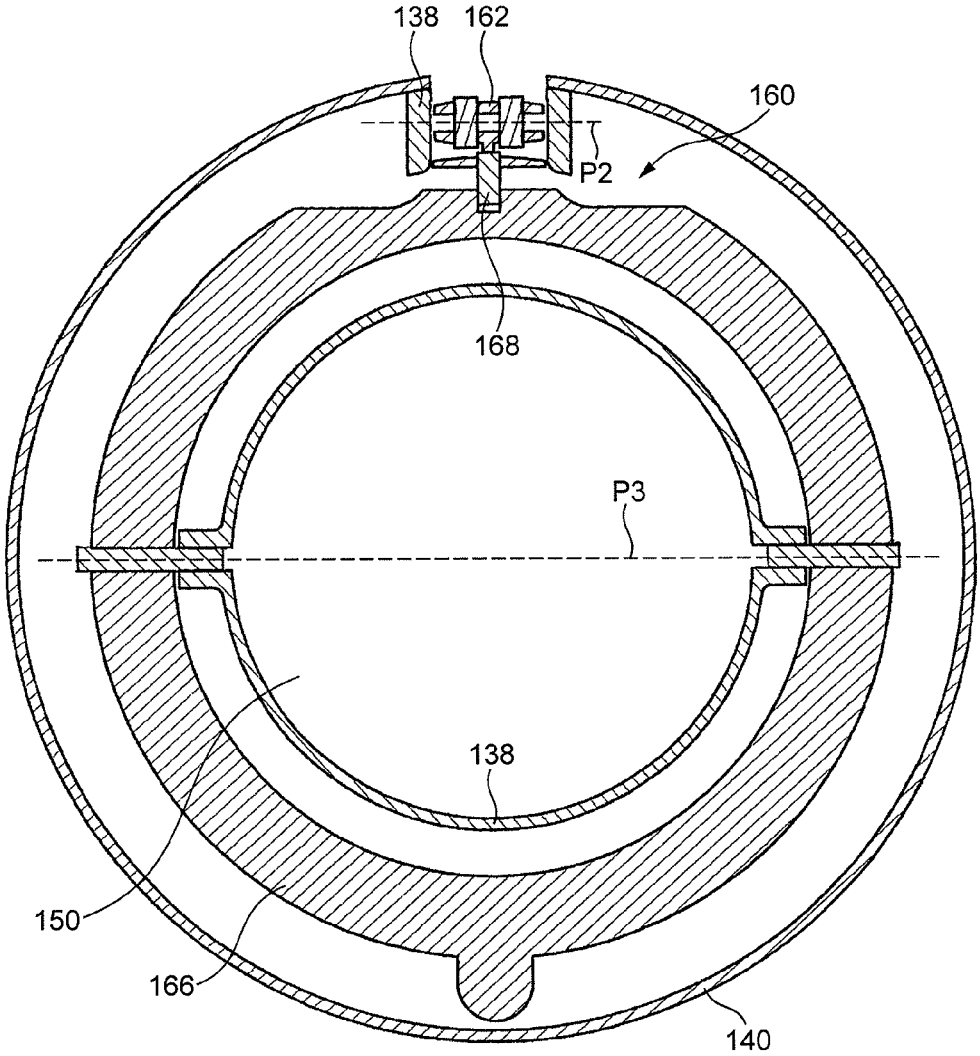
FIG. 12 is a sectional view of the locking mechanism, taken along line B-B in FIG. 11.

The housing 156 of the body 104 also houses a releasable locking mechanism 160 for locking the position of the body 104 relative to the arm 102. The locking mechanism 160 serves to retain the body 104 in a position whereby the nozzle is in its raised position. With reference to FIGS. 11 and 12, in this example the locking mechanism 160 comprises a locking wedge 162 for engaging the second end 136 of the arm 102 and an upper portion 164 of the body 104 to inhibit relative movement between the arm 102 and the body 104. The locking wedge 162 is connected to the inner body section 138 for pivoting movement relative thereto about a second pivot axis P2. The second pivot axis P2 is substantially parallel to the first pivot axis P1. The locking wedge 162 is retained in a locking position illustrated in FIG. 11 by a locking arm 166 which extends about the inner body section 138 of the body 104. A locking arm roller 168 is rotatably connected to the upper end of the locking arm 166 to engage the locking wedge 162, and to minimize frictional forces between the locking wedge 162 and the locking arm 166. The locking arm 166 is connected to the inner body section 138 for pivoting movement relative thereto about a third pivot axis P3. The third pivot axis P3 is substantially parallel to the first pivot axis P1 and the second pivot axis P2. The locking arm 166 is biased towards the position illustrated in FIG. 11 by a resilient element 170, preferably a spring, located between the locking arm 166 and the flange 142 of the inner body section 138.

To release the locking mechanism 160, the user pushes the locking arm 166 against the biasing force of the resilient element 170 so as to pivot the locking arm 166 about the third pivot axis P3. The outer body section 140 comprises a window 172 through which a user may insert a tool to engage the locking arm 166. Alternatively, a user operable button may be attached to the lower end of the locking arm 166 so as to protrude through the window 172 for depression by the user. The movement of the locking arm 166 about the third pivot axis P3 moves the locking arm roller 168 away from the second end 136 of the arm 102, thereby allowing the locking wedge 162 to pivot about the second pivot axis P2 away from its locking position and out of engagement with the second end 136 of the arm 102. The movement of the locking wedge 162 away from its locking position allows the body 104 to pivot relative to the arm 102 about the first pivot axis P1 and so move the nozzle 14 from its raised position to its lowered position.

Once the user has rotated the nozzle 14 about the longitudinal axis L by the desired amount, the user can return the nozzle 14 to its raised position by lifting the end of the nozzle 14 so that the body 104 pivots about the first pivot axis P1. As the locking arm 166 is biased towards the position illustrated in FIG. 11, the return of the nozzle 14 to its raised position causes the locking arm 166 to return automatically to the position illustrated in FIG. 11, and so return the locking wedge 162 to its locking position.

To operate the ceiling fan 10 the user depresses an appropriate button of the user interface or the remote control. A control circuit of the user interface communicates this action to the main control circuit, in response to which the main control circuit activates the motor 26 to rotate the impeller 22. The rotation of the impeller 22 causes a primary air flow to be drawn into the body 104 of the support assembly 16 through the air inlet 150. The user may control the speed of the motor 26, and therefore the rate at which air is drawn into the support assembly 16, using the user interface or the remote control. The primary air flow passes sequentially along the air passage 150 of the support assembly 16 and the air passage 152 of the air inlet section 12, to enter the interior passage 94 of the nozzle 14.

Within the interior passage 94 of the nozzle 14, the primary air flow is divided into two air streams which pass in opposite directions around the bore 78 of the nozzle 14. As the air streams pass through the interior passage 94, air is emitted through the air outlet 90. As viewed in a plane passing through and containing the bore axis X, the primary air flow is emitted through the air outlet 90 in the direction D. The emission of the primary air flow from the air outlet 90 causes a secondary air flow to be generated by the entrainment of air from the external environment, specifically from the region around the nozzle. This secondary air flow combines with the primary air flow to produce a combined, or total, air flow, or air current, projected forward from the nozzle 14.

The invention claimed is:

1. An annular nozzle for a ceiling fan, the nozzle comprising an inner wall defining a bore having a bore axis, an outer wall extending about the inner wall, an air inlet, an air outlet section extending between the inner wall and the outer wall, the air outlet section comprising at least one air outlet, and an interior passage extending about the bore axis for conveying an air flow to the air outlet section, wherein the air outlet section is configured to emit the air flow away from the bore axis, and wherein the air outlet section comprises an inner section connected to the inner wall, and an outer section connected to the outer wall, the air outlet section forming at least part of a lower end wall of the nozzle, and wherein at least part of the inner section tapers away from the bore axis.

2. The nozzle of claim 1, wherein an angle of inclination of said at least part of the inner section to the bore axis is between 0 and 45°.

3. The nozzle of claim 1, wherein said at least part of the inner section has a shape which is substantially conical.

4. The nozzle of claim 1, wherein the air outlet section is arranged to emit the air flow in a direction which is substantially parallel to said at least part of the inner section.

5. The nozzle of claim 1, wherein said at least one air outlet is located between the inner section and the outer section.

6. The nozzle of claim 1, wherein the outer section is substantially orthogonal to the bore axis.

7. The nozzle of claim 1, wherein said at least one air outlet extends about the bore axis.

8. The nozzle of claim 1, wherein said at least one air outlet comprises a substantially annular air outlet.

9. The nozzle of claim 1, wherein the air outlet section comprises an air channel for conveying the air flow from the interior passage to said at least one air outlet.

10. The nozzle of claim 9, wherein the air channel is inclined to the bore axis.

11. The nozzle of claim 10 wherein an angle subtended between the air channel and the bore axis is between 0 and 45°.

12. The nozzle of claim 1, wherein the interior passage extends about the bore axis.

13. The nozzle of claim 1, comprising a chord line extending midway between the inner wall and the outer wall, and wherein said at least one air outlet is located between the bore axis and the chord line.

14. The nozzle of claim 1, wherein the interior passage has a substantially rectangular cross-section in a plane passing through the bore axis.

15. A ceiling fan comprising the nozzle of claim 1.

16. The ceiling fan of claim 15, comprising an air inlet section connected to the outer wall of the nozzle.

17. The ceiling fan of claim 16, wherein the air inlet section comprises an inlet, an impeller and a motor for rotating the impeller about an impeller axis to draw an air flow through the inlet of the air inlet section.

18. The ceiling fan of claim 17, wherein the impeller axis is substantially orthogonal to the bore axis.

19. An annular nozzle for a ceiling fan, the nozzle comprising an inner wall defining a bore having a bore axis, an outer wall extending about the inner wall, an air inlet, an air outlet section extending between the inner wall and the outer wall, the air outlet section comprising at least one air outlet, and an interior passage extending about the bore axis for conveying an air flow to the air outlet section, wherein the air outlet section is configured to emit the air flow away from the bore axis, and wherein the interior passage has a substantially rectangular cross-section in a plane passing through the bore axis.

* * * * *